United States Patent [19]

Lofland

[11] Patent Number: 4,856,289

[45] Date of Patent: Aug. 15, 1989

[54] APPARATUS FOR RECLAIMING AND PURIFYING CHLORINATED FLUOROCARBONS

[76] Inventor: Spencer G. Lofland, 1014 Papaloa, Bastrop, Tex. 78602

[21] Appl. No.: 216,894

[22] Filed: Jul. 8, 1988

[51] Int. Cl.[4] ..... F25B 45/00

[52] U.S. Cl. ..... 62/149; 62/125; 62/292; 62/511; 62/513

[58] Field of Search ..... 62/149, 77, 292, 85, 62/195, 503, 113, 513, 511, 125

[56] References Cited

U.S. PATENT DOCUMENTS

| | | | |
|---|---|---|---|
| 2,341,430 | 2/1944 | Elsey | 62/170 |
| 2,400,620 | 5/1946 | Zwickl | 62/115 |
| 3,699,781 | 10/1972 | Taylor | 62/474 |
| 4,104,044 | 8/1978 | Lange | 62/324 |
| 4,180,988 | 1/1980 | Forte et al. | 62/474 |
| 4,245,483 | 1/1981 | Murai | 62/376 |
| 4,285,206 | 8/1981 | Koser | 62/126 |
| 4,363,222 | 12/1982 | Cain | 62/292 |
| 4,441,330 | 4/1984 | Lower et al. | 62/149 |
| 4,476,688 | 10/1984 | Goddard | 62/149 |
| 4,554,792 | 11/1985 | Margulefsky et al. | 62/77 |
| 4,646,527 | 3/1987 | Taylor | 62/85 |
| 4,689,969 | 9/1987 | Van Steenburgh, Jr. | 62/474 |
| 4,805,416 | 2/1989 | Manz et al. | 62/292 |
| 4,809,515 | 3/1989 | Houwink | 62/149 |

*Primary Examiner*—Harry B. Tanner

*Attorney, Agent, or Firm*—Wood, Herron & Evans

[57] ABSTRACT

The invention is a device for recovering contaminated chlorinated fluorocarbons (CFCs) from refrigeration apparatus, and purifying them for reuse. The CFC can be received in either vapor or liquid state, and is distilled and purified first in vapor state. The vapor is then superheated, compressed and condensed to a liquid state and is further purified in the liquid state. Heat of the condensed liquid stream is applied to help vaporize incoming CFC to heat the vapor so as to prevent recondensation, and to superheat the vapor prior to compression.

17 Claims, 3 Drawing Sheets

APPARATUS FOR RECLAIMING AND PURIFYING CHLORINATED FLUOROCARBONS

FIELD OF THE INVENTION

This invention relates to the recovery and purification of old or contaminated chlorinated fluorocarbons (CFCs) from refrigeration units and the like.

BACKGROUND OF THE INVENTION

For many years CFCs, of which DuPont's "Freon" is a well known commercial brand, have been the standard heat transfer media in refrigeration units, air conditioners, heat pumps, and the like. The reason for their wide spread use is that CFCs are stable and nonflammable, boil and condense in a useful temperature and pressure range, and were believed relatively inert and free of harmful side affects. Recently, however, a serious impact on the ozone layer of CFCs released into the atmosphere has been discovered, and it is now necessary to avoid open air release of CFCs from equipment which contains them. In the normal use of CFC-containing equipment, the CFC is, of course, constantly recycled and is not released to the atmosphere. However, over time the CFC gradually becomes contaminated in the equipment and loses its effectiveness. The common contaminants include water, air, compressor oil, hydrochloric acid, waxes, varnishes, and the like. Such contamination accelerates the rate of breakdown of the CFC, because it increases compressor operating temperature. Moreover, prolonged operation at higher temperatures can cause compressor or compressor drive failure.

For many years it was common practice in the industry simply to release contaminated CFC to the atmosphere. Now, however, that is no longer acceptable practice; nor is it responsible to abandon CFC containing equipment because it would eventually leak out. It thus is becoming increasingly desirable to service CFC containing units to purify the CFC in them or replace it with pure CFC in a manner which prevents any loss to the atmosphere or the environment.

THE PRIOR ART

While different types of apparatus have been proposed for removing CFC from existing units and purifying it for replacement or reuse, such equipment has been limited in application, inefficient in use, and does not sufficiently avoid loss of CFC. Some previous apparatus was adapted to receive CFC only in the vapor phase or in the liquid phase, but not both, and thus was of limited utility. In other apparatus, CFC was not fully recovered from the old unit, and a portion was lost to atmosphere; and/or purification was relatively poor. Even an impurity level of as little as 1% can significantly impair the heat exchange capabilities of the CFC in a given piece of equipment and shorten its life span. Moreover, the act of recovery of itself can impart some impurities to the CFC, for example, compressor oil, which previous apparatus has neglected to remove.

BRIEF DESCRIPTION

This invention provides a highly efficient apparatus which can be attached to a unit containing old or contaminated CFC for removing and purifying substantially all the CFC in the old unit, whether in liquid form, vapor form, or partly in each, and for purifying the CFC to a high level of purity. Such recovery and purification are achieved without release of any CFC to the atmosphere. The apparatus may be connected "on line" to an existing unit to purify the CFC of that unit, or the recovered purified CFC may be delivered to a storage container for reuse or resale. Tests of material so purified have shown it to be as pure or even purer than commercially available new CFC.

In the preferred embodiment of the present invention, the contaminated CFC is withdrawn from the old unit into the apparatus of the invention, in which it is first distilled to convert it all to a vapor state rather than merely expanding it by pressure reduction. It is first purified in the vapor phase by removing entrained liquid droplets, water and vapor-phase contaminants. The vapor is then superheated and compressed. Any compressor oil which has become admixed with the compressed vapor is removed, and noncondensable gases such as air are separated from the compressed vapor. The vapor is then condensed; and the condensed, partly purified liquid CFC is then further purified by removing water and/or other liquid contaminants. The CFC is returned to the unit from which it was removed, or is sent to a separate container for reuse or disposal.

The apparatus minimizes the total expenditure of energy in the purification process. In part this is achieved by initially converting the received CFC to the vapor phase and then purifying the CFC as vapor, before compressing and condensing it, then further purifying it in the liquid phase. Moreover, the initial distillation is accomplished with heat added from warm, previously compressed and condensed liquid purified CFC. The vapor, once obtained, is further heated by warm recondensed liquid while being purified; and the vapor is superheated prior to compression by heat extracted in condensation, that is, without supplying heat energy from an outside source. A significant advantage is gained by superheating the vapor, i.e., heating it above its saturation point, prior to compressing it. Superheating the vapor before compressing it facilitates the extraction of non-condensable gases after compression.

Once condensed the liquid CFCs are cooled with ambient air and by loss of heat to vaporize incoming liquid CFC. The apparatus does not require the use of artificial cooling (other than a fan) to remove the heat from the hot compressed gas in order to condense it. The purified CFC is delivered to a final outlet at nearly ambient temperature and pressure.

DETAILED DESCRIPTION

The invention can best be further described by reference to the accompanying drawings in which.

Figure 1:
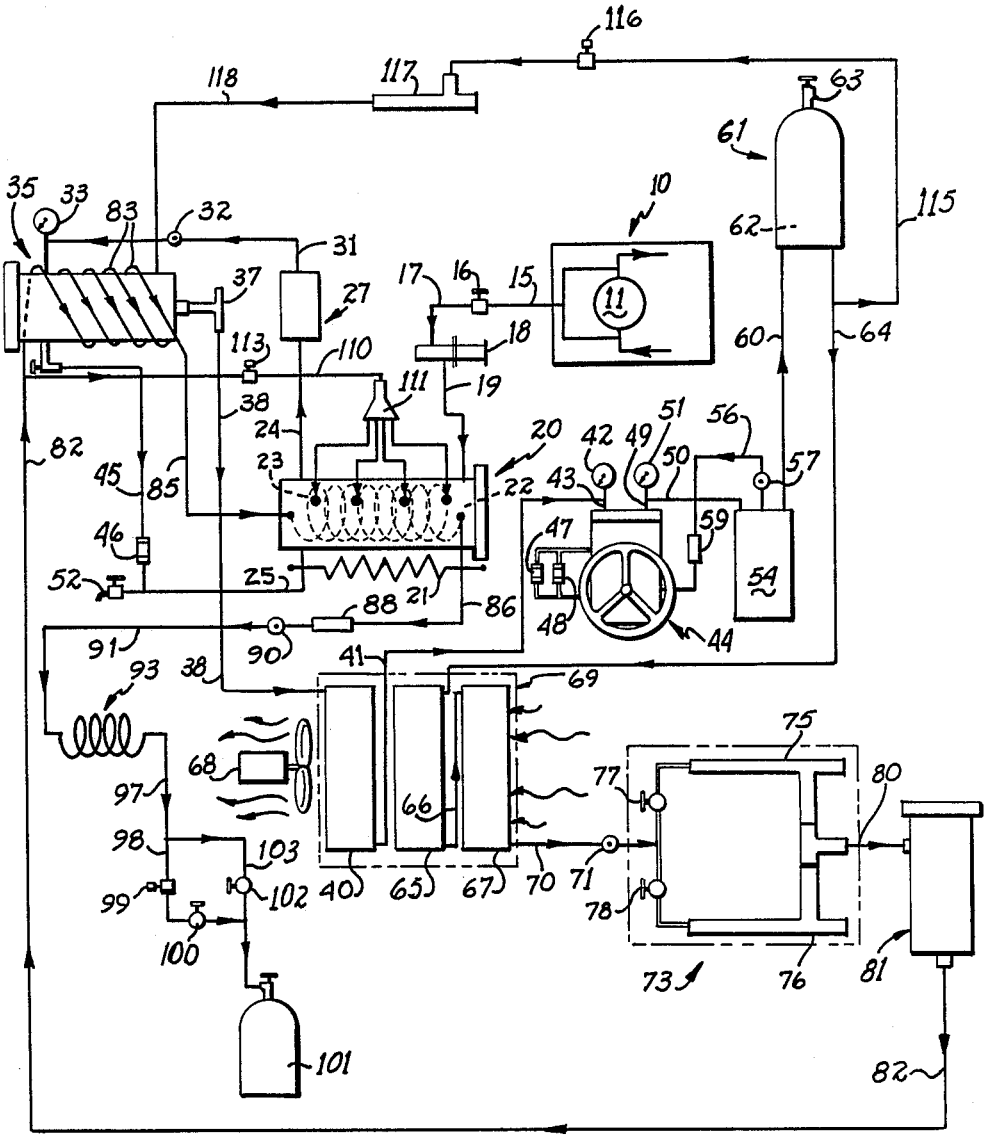
FIG. 1 is a schematic diagram of apparatus in accordance with a preferred embodiment of the present invention.

The present apparatus may be and preferably is constructed as a self-contained portable package 5 which can be moved as needed to a site to remove CFC from an existing unit or device 10. Device 10 may be a refrigeration unit, a chiller, an air conditioner, a heat pump or the like. It is contemplated that the apparatus 5 of this invention may be connected to an old unit 10 (for example, to the inlet or outlet of its compressor 11), as needed to purge the old unit and to purify the CFC removed from it. Where the purified CFC is to be returned to unit 10 being serviced, that unit may continue to operate during the actual purification by shunting liquid CFC from the old unit through the apparatus 5, and returning it to the same liquid line.

Figure 2:
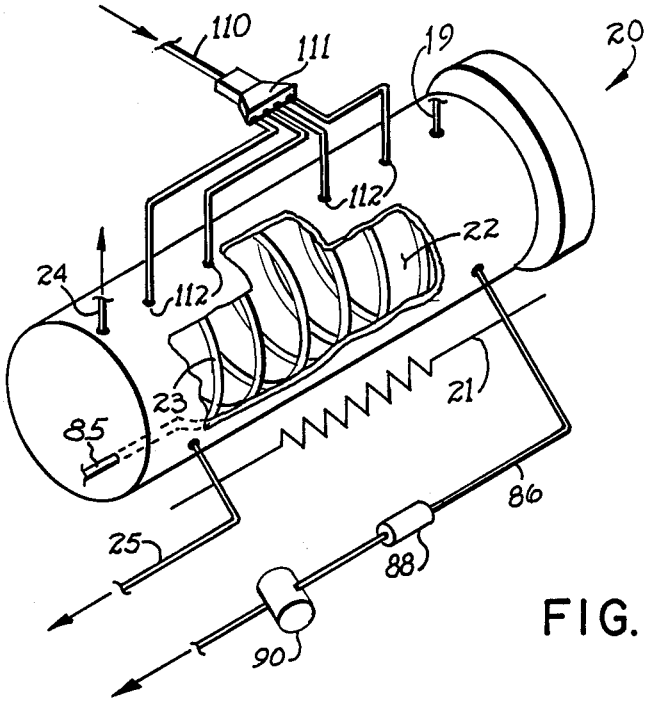
FIG. 2 is an enlarged diagrammatic view, partly broken away, of the still and certain adjacent components of the apparatus shown in FIG. 1.
Figure 3:
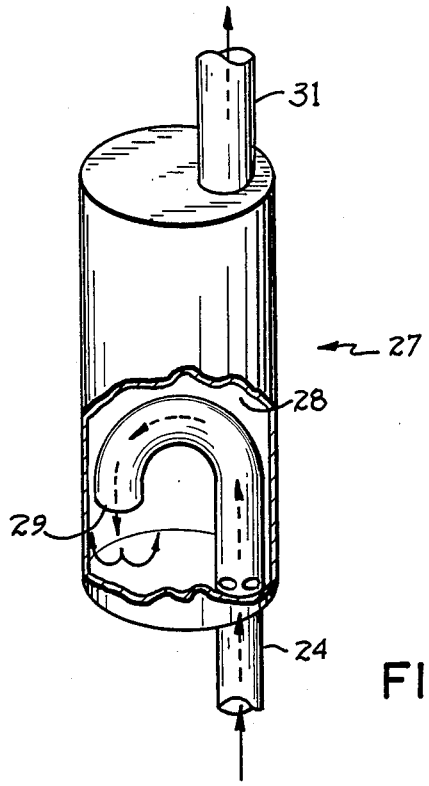
FIG. 3 is an enlarged diagrammatic view, partly broken away, of the liquid eliminator of the apparatus shown in FIG. 1.

Apparatus 5 is adapted to receive the contaminated CFC whether it is in liquid state, vapor state, or portions are in both states, through an inlet line 15 having a manual shut-off valve 16. From valve 16 the liquid or vapor from the incoming material flows via line 17 through a pressure regulating valve 18 which prevents the entering pressure from exceeding a desired maximum, e.g., about 30 psig when CFC 12 is to be processed. A line 19 communicates from valve 18 to a still 20 (shown in more detail in FIG. 2). Still 20 is heated in part by a source of energy from outside the apparatus, such as an electric heater 21, and vaporizes liquid CFC in its distillation chamber 22 (see FIG. 2). The distillation separates and leaves behind oils, liquid acids, water, particulates, varnishes, and waxes. The still temperature should be less than 100° F., and well above 32° F., in order to prevent contaminate water from boiling or freezing. Depending on ambient temperature, the still chamber temperature for vaporizing CFC 12 may be about 40° F. Distillation chamber 22 contains a tubular heating coil 23, as subsequently described. Any liquid which cannot be vaporized accumulates at the bottom of the chamber 22 and can be removed through a still bottoms line 25. The distillation separates the CFC from the non-vaporizing contaminants, whereas expansion (i.e., vaporizing through a restricted orifice or metering device) permits the contaminants largely to carry over. The vaporized gas (which may contain entrained liquid droplets) leaves chamber 22 of still 20 via line 24 which communicates with a liquid eliminator 27 (see FIG. 3). Liquid eliminator 27 has an upright internal chamber 28, into which line 24 extends as a downturned U having an outlet 29 in chamber 28. An outlet line 31 extends from the top of chamber 28. Liquid droplets entrained with vapor entering chamber 28 from line 24 lose velocity on exiting from outlet 29 into chamber 28 and settle by gravity to the chamber bottom while the vapor exits upwardly through line 31. Liquid in chamber 28 can migrate back to still chamber 20 through line 24, to be reheated and vaporized or drained off via line 25.

Line 31 carries the vapor through a sight glass 32 wherein the presence of any remaining liquid can be observed, to a pressure gauge 33 and into a vapor drier or separator designated generally by 35. The vapor drier continues the purification and drying of the vapor (which began in still 20 and continued in liquid eliminator 27), and traps any residual condensable liquid left at this point. The drier has an internal chamber which contains a vapor porous plug core of an absorptive medium such as activated charcoal, and is effective to absorb water, acids (such as hydrochloric acid, etc.) contained in the vapor in line 31. One example of a suitable commercially available device for this purpose is sold by Sporlan Valve Co., St. Louis, Missouri, under the brand name "Catchall" molded porous core filter-drier. Any liquid which accumulates in the chamber of vapor drier 35 drains by gravity past a sight glass 46 and can either be returned to still chamber 22 via line 25 or removed and disposed of separately via outlet 52.

From drier 35 the vapor passes through a pressure regulator 37, thence by a line 38 to a superheater 40 which may be of the finned coil type and in which the vapor is further heated, to a temperature above its saturation point. The superheater is heated by the passage of air over it which has in turn been heated by flow over a hot condenser, as will be explained.

From superheater 40 the CFC gas passes through a line 41, having a compressor inlet or low pressure gauge 42, into the inlet port 43 of a compressor 44. The oil level in the compressor crankcase is monitored by bi-level sight glasses 47 and 48, which permit monitoring the maximum high oil level and minimum low oil level so that appropriate adjustments can be made.

From outlet port 49 of compressor 44, the compressed, further heated vapor flows via a line 50 which has pressure gauge 51, to an oil separator 54. The oil separator removes any oil droplets from the compressed superheated vapor and returns it to the sump of compressor 44 via an oil return line 56 having a sight glass 57 and a oil filter 59. Oil separator 54 may be of a type known per se.

From oil separator 54 the hot compressed gas flows via line 60 to a separator 61 for separating non-condensable gas. This separator has a vertically elongated chamber 62 having a height substantially greater than its diameter. The usually encountered non-condensable gases, such as air, mixed with the CFC are lighter than the CFC and therefore tend to rise to the top of chamber 62, from which they may be removed through a valve 63. The CFC vapor, which is heavier than common non-condensable impurities, remains near the bottom of chamber 62 and exits that chamber via line 64. A vapor bypass line 115 extends from line 64 to the chamber of vapor drier/separator 35. This line 115 includes a solenoid valve 116 and a pressure regulator 117, which when valve 116 is open maintains a predetermined pressure in line 118, as will be explained.

Below the junction with line 115, line 64 leads to a condenser 65 wherein the CFC is circulated through a finned heat exchanger and is cooled in air to a temperature sufficiently low that the CFC condenses almost completely to liquid state.

From condenser 65 the now mostly liquid CFC is passed via line 66 to a sub-cooler 67, which condenses any remaining CFC vapor and further cools the CFC to a temperature several degrees below its condensing temperature. For reference, the boiling points at atmospheric pressure of some of the common CFCs are:

| | |
|---|---|
| "Freon" 11 ($CCl_3F$) | 75° F. |
| "Freon" 12 ($CCl_2F_2$) | −22° F. |
| "Freon" 22 ($CHClF_2$) | −41° F. |
| "Freon" 500 (azeotrope) | −28° F. |
| "Freon" 502 (azeotrope) | −50° C. |

As indicated in FIG. 1 by the dashed line around superheater 40, condenser 65 and sub-cooler 67, those three elements are in heat exchanging relationship, that is, air passing over the coils of elements 67 and 65 is warmed by them, then passes over superheater 40 to heat the gas in it. So arranged, these three elements form what may be referred to as a "tri-coil assembly" 69. A multi-speed fan 68, the speed of which can be electrically adjusted, provides the air flow across the tri-coil assembly and may be thermostatically controlled so as to increase air circulation rate when additional cooling is needed at the condenser, which adds more heat to the superheater. The condensed CFC, now cooled substantially below the temperature at which it was condensed, flows via line 70 through a liquid sight glass 71 to a pressure regulating means 73, by which its pressure is maintained at a level sufficient to assure condensation downstream of the condenser.

As already noted, different CFC compounds boil at different temperatures, and thus the apparatus must be set to maintain a pressure appropriate for the particular CFC being treated. (The particular CFC content is usually listed on each unit 10.) To quickly set the appropriate pressure, it is desirable to provide a pressure regulating means 73 which is preset to pressures appropriate for the common specific CFC. For that purpose I prefer to provide two or more individually selectable, pre-set separate pressure regulators, which are connected in parallel. In the embodiment shown two separate pressure regulators are provided in parallel, one of which, designated at 75, maintains a pre-set higher pressure than the second valve pressure regulator 76. Selection of one of the regulators 75, 76 is controlled respectively by manually operated valves 77 and 78 at their inlet sides. Similarly, where a larger range of different types of CFCs might be encountered, three, four or more pressure regulators could be provided in parallel, each preset to maintain an appropriate pressure in line 82.

From pressure regulating means 73 the liquid CFC is conducted via line 80 to a liquid drier 81. This drier, which may be similar in principle to vapor drier 35, contains a plug or filter of material which will absorb any residual water, hydrochloric acid or other common contaminants of the CFC, but is adapted to treat liquid flow rather than the gaseous flow handled by drier 35. I have found excellent results are obtained by drying and partly purifying before compression, and then by further purifying the liquid after compression and condensation.

From drier 81 the liquid flows via line 82 to a cooling coil 83 around the outside of vapor drier/separator 35. The purpose of coil 83 is to dissipate further heat from the liquid in line 82, by using it to preheat the vapor in element 35 (which is at much lower temperature) just prior to its entry into the superheater 40.

It should be noted that a line 110 is connected from liquid line 82 just upstream of coil 83, through a solenoid 113 to a manifold distributor 111 which leads to the chamber 22 of still 20. The manifold divides the flow of line 110 into several smaller streams, and directs it through capillary tubes to multiple injector ports 112 (see FIG. 2), into the still chamber 22, in which the liquid streams are sprayed along the length of coil 23. This line 110 can be opened to selectively reinject a portion of the warm, already purified liquid CFC from line 82 back to the still. This has been found useful to provide cooling of still coil 23, when needed, as will be explained. Solenoid valve 113 is operated electrically in response to the temperature in line 86, so as to reinject liquid when the still chamber temperature is too high for adequate heat transfer from coil 23.

From cooling coil 83 the liquid CFCs pass via line 85 into the coil 23 in chamber 22 of still 20. Here the liquid in the coil gives up heat to the incoming cooler liquid and vapor from line 19 and thus is further cooled. From coil 23 the liquid then flows via line 86 through a CFC purity monitor 88 which preferably includes a device for infrared scanning of the purified CFC (to test for impurities such as moisture, oil, waxes, resins, varnishes and particulates) and a pH sensor (to detect acid content). Such monitoring devices are known per se and are not the invention. Purity monitor 88 may be connected to automatically operate a visual and/or audible warning device, and/or to shut off the apparatus, if quality declines beyond a predetermined level.

Figure 4:
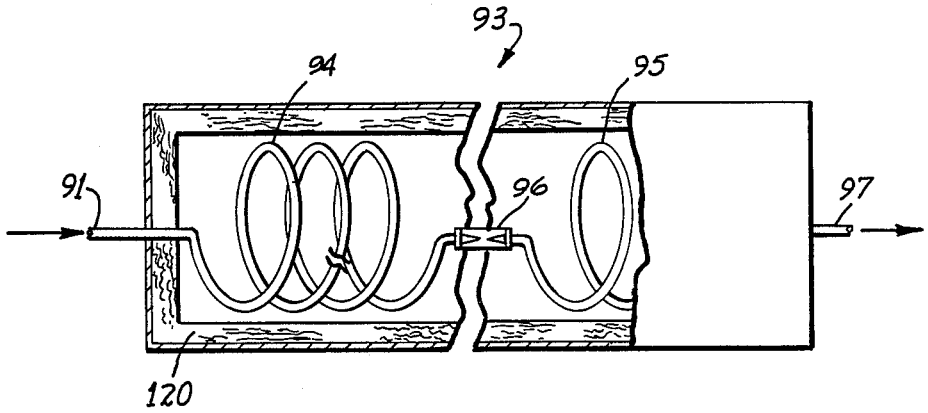
FIG. 4 is an enlarged diagrammatic view of the flow controller of the apparatus shown in FIG. 1.

Downstream of monitor 88 the CFC liquid passes through a visual sight glass 90 by which the operator of the system can visually make a final inspection of the purified CFC liquid before it leaves the apparatus. From sight glass 90 the purified liquid flows via line 91 through a flow controller or throttling means 93, shown in preferred embodiment in FIG. 4. The purpose of this device is to reduce both the pressure and the flow rate of the liquid, without heat gain and without permitting the liquid to expand sufficiently that vaporization occurs. In a preferred form of flow controller 93, two long coils 94, 95 of small diameter tubing, for example six feet long and 3/32" I.D, are separated by back-to-back needle valves at 96. The needle valves 96 do not function as a metering device, but rather as restrictors to reduce the flow rate. The pressure drops across them is insufficient to permit vaporization. Flow controller 93 is preferably in an insulated container 120, so that it allows no heat gain. It thus reduces the rate of flow of, and dissipates pressure in, the liquid without forming much vapor; and any vapor which is formed in the needle valve 96 is soon cooled and reconverted to liquid in coil 95.

From flow controller 93, the liquid CFC flows via lines 97 and 98, solenoid valve 99, and a manual valve 100, to a tank or other receiver 101. Solenoid valve 99 may be operated electrically so that if for any reason the system fails to function properly or stops, the solenoid valve closes in order to prevent reverse flow of CFC from receiver 101 back into the apparatus. If the apparatus is being operated manually, the solenoid valve 99 is closed (deenergized) and the transfer process is controlled through a hand valve 102 in a bypass line 103.

Operation

To start operation, after apparatus 5 has been connected to a unit 10 to be serviced, still chamber electric heater 21 is energized and either the high or the low pressure control valve 77 or 78 is opened, thereby opening a path to which ever pressure control valve 75 or 76 is set appropriately for the particular CFC to be treated. Compressor 44 is started. Fan 68 may initially be run at slow speed, and is switched to higher speed when greater cooling is needed at the tri-coil assembly 69. The contaminated CFC enters the apparatus through valve 16 and passes through pressure regulating valve 18 which regulates the pressure at the entrance to still chamber 22 at a predetermined level appropriate for the particular CFC being processed. The pressure established by valve 18 is selected (e.g. 30 psi for CFC 12) to provide ample time for liquid CFC to be vaporized. This prevents still 20 from receiving CFC liquid too quickly, which would slow the distillation process and could cause contaminates to be flushed out of chamber 22, instead of remaining in the bottom. The pressure established keeps the chamber above 32° F, to prevent freeze up, which would make separation of contaminates difficult. Heating of chamber 22 vaporizes any CFC liquid so as to leave behind most of the oils, liquid acids, water, particulates, varnishes and waxes. Liquid droplets are trapped in the liquid elimination chamber 27 and either revaporize or migrate back into chamber 22. The vapor passes to vapor drier/separator 35 wherein it is cleaned and dried, and wherein any residual liquid is separated and allowed to return back to still chamber 22 through lines 45 and 25. Return of residual liquid to the still takes place because chamber 22 and eliminator 35 are under the same pressure. Also, chamber 35 is preferably located at a higher elevation than chamber 22 so that gravity will assist the transfer back. When liquid transfers back to still chamber 22 it is either vaporized or, if not vaporized, collects in the bottom and can be drained off via line 25 through outlet 52 to a contaminant tank (not shown) for safe disposal. The level of the unvaporized liquid in the still can be monitored at sight glass 46.

After the CFC has been cleaned and dried in vapor drier/separator 35, it passes through pressure regulating valve 37 which establishes a predetermined pressure in outlet line 38, from which the CFC vapor enters superheater 40 of the tri-coil assembly which, as already noted, heats it above its saturation point. The superheated vapor is then compressed by compressor 44.

If the condenser discharge pressure, measured at gauge 51, is above the condensing pressure for the particular CFC at the operating temperature, this indicates the presence of non-condensable contaminants which should be eliminated. For example, from the standard table of condensing pressure/temperature relationships for CFC 12, at 84° F., its condensation pressure is 90 psig. A condenser discharge pressure of 100 psi would therefore indicate non-condensable gases. Such gases are typically lighter than CFC and can be eliminated by purging them at the highest point on the discharge side of the compressor. They can be eliminated by chemical neutralization or captured in a container for safe disposal so that they are not discharged into the atmosphere.

The high pressure bypass line 115, which tees from non-condensable gas separation chamber outlet line 64, is used when the apparatus is started in order to prevent the compressor from pulling a vacuum upstream of its inlet port 43. When the pressure in the chamber of vapor drier 35 begins to drop, pressure regulating valve 117 opens and admits high pressure into vapor drier 35, to keep the system from going into a vacuum. If a final pump out of the unit 10 to be purged is needed, valve 116 can be de-energized and a vacuum obtained in line 15.

The CFC vapor from line 64 enters condenser 65 as a high pressure/high temperature vapor. Ambient air removes heat from the coil of condenser 65, causing the high temperature gas flowing through the coil to change state at its saturation point and condense into a liquid. The CFC thus condensed enters the coil of subcooler 67 where further condensing and sub-cooling takes place, insuring a "solid" liquid CFC column in line 70. This flow can be monitored at the contaminant sight glass 71, which acts as another monitoring point. The sight glass indicates any moisture or acid content (which will cause a color change in the window material of the sight glass) and thereby alerts the system operator that the drier/separator chamber 35 has lost efficiency and that its contaminant removal core must be changed. By using either high pressure selector valve 77 or low pressure selector valve 78, depending on what type of CFC is being recaptured, liquid CFC is maintained at a constant predetermined condensing pressure by valve 76 or 76.

A further stage of CFC purification takes place in the liquid drier 81. Any remaining (or added) contaminants are removed at this point. The CFC leaves liquid drier chamber and flows through line 82 to cooling coil 83 around vapor drier/separator 35, where it gives up some of its heat to vapor in that drier, so that CFC vapor from the still does not recondense in the drier. From cooling coil 83 the liquid then passes through the internal heat exchange coil 23, previously described, in still chamber 22. This actual length of the tubing in chamber 22 may for example be 32 feet long, but it may be coiled into a 16 inch long, five inch diameter spiral. This coil carries the warm high pressure purified CFC liquid, which must be cooled to lose the rest of its heat before transfer into the receiving vessel 101. When filling a storage cylinder with warm CFC, the pressure of the cylinder and the pressure of the system might equalize which would cause transfer to stop. Therefore, it is desirable to provide means for releasing further heat at this point. Moreover, the released heat supplements the electric or other external heater 21, and thereby speeds up the distillation process. This is especially useful if still chamber 22 is receiving a large quantity of cool, contaminated in-flowing CFC. (If the "finished" purified CFC liquid were being transferred back into unit 10, such elimination of added heat may not always be necessary.)

During high ambient temperatures, or when the contaminated CFC vapor entering still chamber 22 is in a vapor state rather than a liquid state, additional cooling is desirable for coil 23 to dissipate heat from it. For this purpose I have discovered that a portion of the purified liquid CFC can be taken from liquid drier output line 82 via line 110 and injected back into still chamber 22, and revaporized. Up to roughly 20% of the liquid CFC available in line 82 may be used in the still reinjection circuit. As the reinjected vaporizing liquid cools the liquid CFC in still coil 23, the process speeds up because as the liquid leaving the system and entering the receiver 101 cools the latter, its pressure is reduced and the flow to it is thereby promoted. As cylinder 101 chills, solenoid valve 113 can be cycled open and closed as needed. For this purpose solenoid valve 113 may be automatically controlled by a temperature sensor on line 86; or valve 113 can be operated manually.

When the end of the cleaning and purifying process is nearing, liquid injection circuit solenoid valve 113 is de-energized and closed so that the contaminated unit 10 can be completely evacuated and the system will drain itself of almost all of its purified CFC, except up to about one pound by weight. This final amount can be pulled out onto an empty cylinder. The purge has then been completed and the apparatus can be used to clean and purify another batch of contaminated CFC, even if of different type.

Condensing temperatures of about 80° to 90° F. are desirable. Regardless of which particular CFC is being processed, the system temperatures and condensing temperatures remain about the same; it is the pressures which vary. For purposes of illustration, as an example of how and where temperatures drop after compression, the temperatures at certain points in the apparatus during the processing of the common CFCs may be approximately as follows:

| | |
|---|---|
| Line 64 | 120°-160° F. |
| Condenser 65 | 84° |
| Supercooler 67 | 79° |
| Line 82 | 79° |
| Line 85 | 68° |
| Line 91 | 58° |
| Line 97 | 55° |
| Receiver 101 | 55° |

As previously indicated, the pressures vary with the CFC being purified; for CFC 12 the condensing pressure at 90° F. is 100 psig, but for CFC 22 at the same temperature, the condensing pressure is much higher, about 168 psig.

From the foregoing it can be observed that the apparatus first converts any incoming CFC liquid to vapor, then purifies the vapor in a first stage; the vapor is then superheated, compressed, condensed and returned to liquid state, and is then further purified in a second stage. I have found it much more effective to purify first vapor, then liquid in this manner, than to purify CFC liquid first. It can further be noted that the vapor is purified prior to compression and the liquid materials are purified after compression and condensation. Further, it can be seen that in the preferred embodiment there are several stages of removing heat from the condensed liquid, including condenser 65, sub-cooler 67, cooling coil 83 around the vapor drier/separator 35, the coil 23 in still 20, and finally, flow controller 93.

Tests have shown that badly contaminated CFC 12 can be purified by this apparatus to a purity equal to 99.91% that of new and unused CFC 12. The remaining impurity content was largely oil, which would be quite acceptable.

Having described the invention, what is claimed is:

1. Apparatus for recovering and purifying contaminated CFC from a device containing it, comprising, inlet means for connection to said device to receive contaminated CFC therefrom, a heated still for vaporizing contaminated CFC which is received in liquid form, a vapor dryer for receiving vapor from the still and drying it to remove non-CFC impurities therein and produce a dry vapor, a superheater for receiving the dry vapor and further heating it, to a temperature above its saturation point, a compressor for receiving superheated vapor from the superheater and compressing the same, thereby further heating the superheated vapor, a chamber for receiving the compressed heated vapor, said chamber adapted to permit noncondensable gases to separate physically from CFC in said vapor to be withdrawn therefrom, a condenser for receiving CFC vapor from said chamber and cooling the same to convert such CFC vapor to liquid, a sub cooler for receiving liquid CFC from the condenser and further cooling the same without revaporization, a drier coil in heat exchanging relation to said vapor drier and a line carrying liquid CFC from said condenser to said coil to heat the vapor drier, a still coil in heat exchanging relation to said still for heating incoming material therein, and a line for carrying liquid CFC from said drier coil to said still coil to heat the still, flow control means for reducing the rate of flow of liquid CFC from said still coil, and outlet means for connection to a receiver for CFC so purified.

2. The apparatus of claim 1 further including a pressure regulator valve connected between said inlet means and said heated still, for preventing pressure in said vaporizer from exceeding a predetermined maximum.

3. The apparatus of claim 1 further including a liquid eliminator connected between said heated still and said vapor dryer, for removing any liquid carried over with vapor from said heated still.

4. The apparatus of claim 1 further including means for draining any liquid removed in said vapor dryer and any liquid not vaporized in said heated still.

5. The apparatus of claim 1 further including a sight glass for determining the presence of liquid in said heated still.

6. The apparatus of claim 1 further including high pressure bypass means operatively connected between said chamber and said vapor dryer, for selectively directing compressed heated vapor from said chamber to said dryer.

7. The apparatus of claim 6 wherein said high pressure bypass means includes a pressure regulating valve which opens to permit flow to said vapor dryer in the event pressure in said drier falls below a predetermined minimum.

8. The apparatus of claim 1 further including a line for returning liquid removed in said vapor dryer to said heated still.

9. The apparatus of claim 1 wherein said condenser is physically adjacent said superheater, and further including fan means for moving ambient air across said condenser to cool the condenser, then across said superheater to heat the latter.

10. The apparatus of claim 9 wherein said subcooler is physically adjacent both said condenser and said superheater, and said fan means moves air first across said subcooler and said condenser, then across said superheater.

11. The apparatus of claim 1 further comprising, pressure regulating valve means connected to said subcooler for maintaining the pressure of CFC therein at a desired level.

12. The apparatus of claim 11 wherein the pressure regulating valve means connected to said subcooler comprises at least two pressure regulating valves which are connectable alternatively to the subcooler to establish two different pressures selected in accordance with the boiling points of specific CFCs to be recovered and purified.

13. The apparatus of claim 1 further comprising an oil separator for receiving the compressed vapor from the compressor and removing any compressor oil droplets entrained therein.

14. The apparatus of claim 1 further comprising a liquid dryer for removing any non-CFC liquids from liquid CFC from said condenser.

15. The apparatus of claim 1 further wherein said flow control means includes a coil to recombine any flash gas and liquid.

16. Apparatus for recovering and purifying contaminated CFC from a device containing it, comprising, inlet means for connection to said device to receive contaminated CFC therefrom, a still having a chamber connected to said inlet means, means for heating said still to vaporize any CFC which is received in said chamber in liquid phase, a vapor drier connected to said chamber to receive vapor from it and to remove impurities therein, thereby producing a dry vapor, said vapor drier including a vapor drier coil which is in heat exchange relation with it, a superheater for receiving dry vapor from the vapor drier and heating it sufficiently above its saturation point to prevent condensation of CFC therein, a compressor for receiving superheated vapor from the superheater and compressing the same, thereby further heating said superheated vapor, means for separating the vapor compressed by the compressor into a non-condensable gas fraction and a CFC gas fraction thereof, and for removing the non-condensable gas fraction, a condenser for receiving the CFC gas fraction from said separating means and cooling the same to convert at least a part of the CFC gas fraction to liquid, a sub-cooler for receiving the CFC from the condenser and further cooling the same to convert the same fully into the liquid phase, a line carrying liquid CFC from the subcooler to said vapor drier coil, wherein such liquid CFC gives up heat to the vapor drier, a still coil in heat exchange relation with said still, a line carrying the liquid CFC from the vapor drier coil to said still coil wherein it gives up further heat to CFC in said still without substantial loss of pressure, means to reduce the temperature of the liquid CFC to substantially ambient temperature, and an outlet for connection to a receiver for CFC so purified.

17. The apparatus of claim 16, further including means for selectively feeding already purified CFC back into said chamber of said still, thereby to provide cooling of said coil when needed.

* * * * *